US005479675A

United States Patent [19]

Pytlewski

[11] Patent Number: 5,479,675

[45] Date of Patent: Jan. 2, 1996

[54] HAND TROWEL ASSEMBLY

[76] Inventor: Walter W. Pytlewski, East 5255 Seltice Way, Post Falls, Id. 83854

[21] Appl. No.: 396,702

[22] Filed: Mar. 1, 1995

[51] Int. Cl.[6] ..... B05C 17/10

[52] U.S. Cl. ..... 15/235.4; 15/145; 16/114 R; 403/325; 403/329

[58] Field of Search ..... 15/145, 235.4–235.8, 15/245.1; 16/114 R; 403/321, 325, 326, 329, 381; 425/458

[56] References Cited

U.S. PATENT DOCUMENTS

| | | | |
|---|---|---|---|
| 398,732 | 2/1889 | Kautz | 15/235.8 |
| 583,006 | 5/1897 | Wilson et al. | 15/235.8 |
| 737,831 | 9/1903 | Feraud | 15/235.4 |
| 961,302 | 6/1910 | Linville | 15/235.8 |
| 1,003,388 | 9/1911 | Wilson | 15/235.4 |
| 1,111,433 | 9/1914 | Brandstrom | 15/235.4 |
| 1,125,844 | 1/1915 | Hardsocg | 15/235.4 |
| 1,166,293 | 12/1915 | Wilson | 15/235.8 |
| 1,212,826 | 1/1917 | Smith | 15/235.8 |
| 1,249,580 | 12/1917 | Wilson | 15/235.8 |
| 1,763,066 | 6/1930 | Rooney | 15/235.8 |
| 3,166,776 | 1/1965 | Selck | 15/235.6 |
| 4,316,302 | 2/1982 | Clark | 15/235.4 |
| 4,556,339 | 12/1985 | Morrison | 404/112 |
| 4,724,572 | 2/1988 | Gringer | 15/235.4 |
| 4,817,231 | 4/1989 | Ocwieja | 15/235.4 |
| 4,958,399 | 9/1990 | Toal et al. | 15/235.4 |
| 5,193,244 | 3/1993 | Meyers | 15/235.4 |

FOREIGN PATENT DOCUMENTS

| | | | |
|---|---|---|---|
| 667530 | 7/1963 | Canada | 16/114 R |
| 6-220988 | 8/1994 | Japan | 15/235.4 |

*Primary Examiner*—Mark Spisich
*Attorney, Agent, or Firm*—Robert Louis Finkel

[57] ABSTRACT

An elongated dovetail tongue on the top surface of the trowel blade slips endwise into a closely conforming groove formed in the base of the removable handle until its end abuts a shoulder at the end of the groove. The tongue is longer than the groove, and a keeper is adapted to slip onto and abut the end of the tongue protruding from the groove. A boss on the end of a resilient arm extending from the keeper engages a detent in the base, locking the keeper to the handle, immobilizing the tongue, and thereby securing the handle to the blade. Disengaging the detent mechanism releases the keeper and allows it to be removed and the handle readily separated from the blade. In the preferred embodiment, the tongue comprises a pair of upwardly divergent flanges attached to the top surface of the blade, and the groove is defined by the downwardly convergent walls of a channel formed in the underside of the base,

10 Claims, 2 Drawing Sheets

FIG. 4
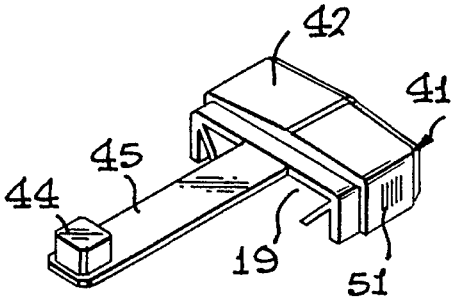
FIG. 5
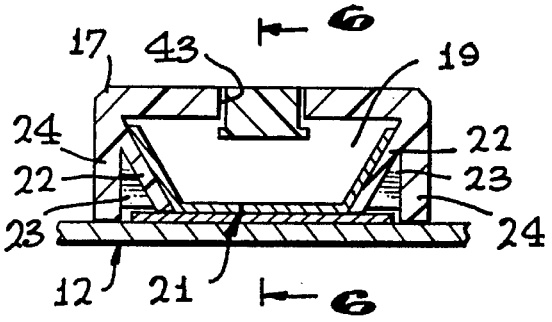
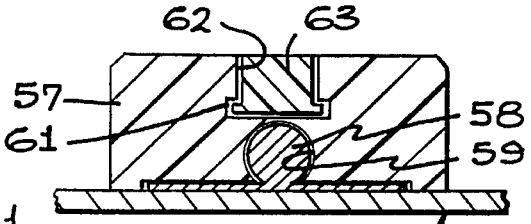
FIG. 9
FIG. 6
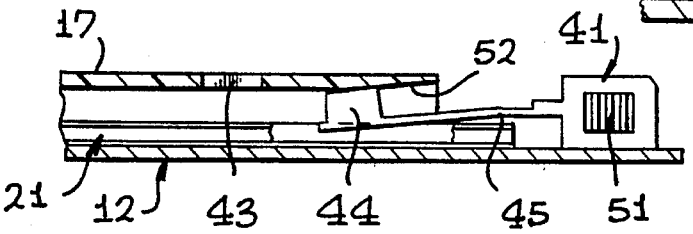
FIG. 10
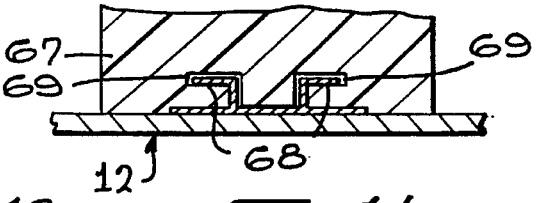
FIG. 7
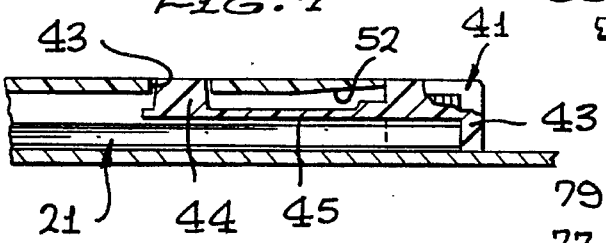
FIG. 11
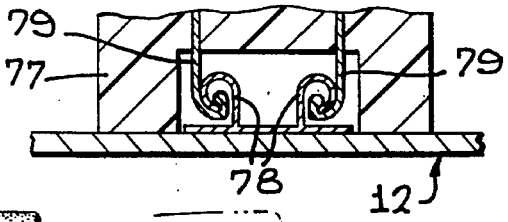
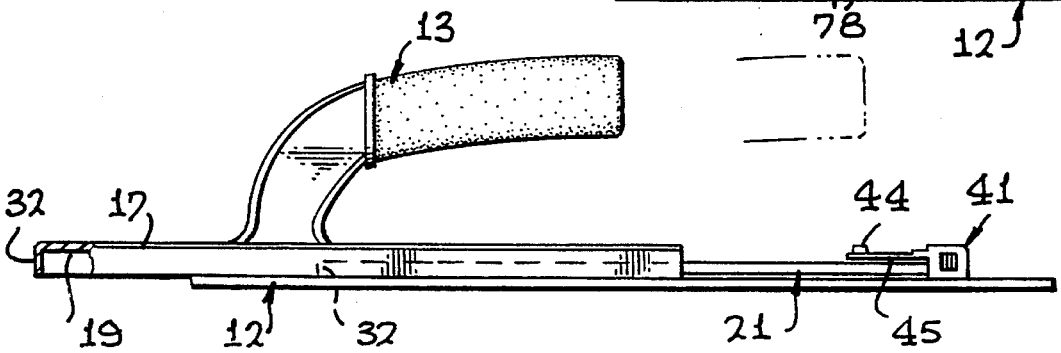
FIG. 8

HAND TROWEL ASSEMBLY

BACKGROUND OF THE INVENTION

1. Field of the Invention

This invention relates to hand trowel assemblies comprising a trowel blade and a handle, and more particularly to such assemblies in which the handle and blade are separable and replaceable.

2. Prior Art

The many uses and advantages of hand trowels for carrying, spreading, working and smoothing plaster, mortar, adhesives, and the like, are too well known to require elaboration. Trowel blades come in a variety of sizes, shapes and materials, and with an array of design and construction features adapted for special tasks. Trowel handles, likewise, are now available in various configurations, constructions and materials suitable to the user's needs and tastes.

The prior art has long recognized the desirability of providing means for replacing and interchanging handles and blades. The call for such means by industry, the construction trades, the arts and crafts, and individual users has been heard by those skilled in the art. The response has led to the development of all manner of trowels, trowel assemblies, detachable handles and blades, and alternative mounting arrangements. This invention is of the second category, a novel trowel assembly.

In typical prior art trowel assemblies, attachment means in, on, or associated with the handle cooperate with receiving means on the blade for releasably mounting the handle to the blade. Devices employing virtually every mounting means known to man, from interlocking slides, bayonet attachments, spring clips, nuts and bolts, screws, hinges and cams, to magnetism, adhesives, and even "Velcro" fasteners have been proposed. Many have been patented. Some have achieved a degree of commercial success. Most of them, however, suffer from one or more inherent deficiencies which make their use unnecessarily difficult, time-consuming, expensive, or otherwise unsatisfactory.

By way of example, many of the prior art assemblies are cumbersome and awkward to assemble and disassemble. Many are simply too heavy for commercial use. Others utilize interlocking components and structures which fail, or can be operated, if at all, only with great effort, when they are damaged or become fouled in customary use. Others call for the handling and manipulation at the job site and under less than favorable conditions of small, easily lost, difficult to operate parts and hardware.

Other designs may operate fairly well at the outset, but wear poorly and become unusable with use. Still others are so complex and cumbersome that they are impractical for commercial use. Additionally, assemblies of this type are relatively costly to fabricate, and many have a tendency to deteriorate with wear and exposure.

Some of the prior art devices employ constructions which, while useful for a specific purpose or with a particular combination of handle and blade, do not lend themselves to other uses, or other combinations.

Because of their potential utility and the demand for them, the development of trowel assemblies has been active and extensive. Despite these efforts, however, heretofore no single trowel assembly has been produced or disclosed which avoids the aforementioned deficiencies.

Viewed against this background, one object of the subject invention is to provide a hand trowel assembly which affords the advantages and overcomes the deficiencies inherent in prior art assemblies.

Another object is to provide an assembly which is sturdy, lightweight, and durable, yet relatively inexpensive to fabricate.

Yet another object is to provide a trowel assembly which allows the handle and blade to be assembled and disassembled quickly and easily in the field and under adverse conditions without need for special tools and equipment.

An additional object is to provide a trowel assembly which can be adapted readily for use with handles and blades of various sizes, shapes, designs, features, constructions, and materials.

Other objects will become apparent from the following summary of the invention and detailed description of its preferred embodiments.

SUMMARY OF THE INVENTION

The subject invention allows conventional hand trowel blades and handles of virtually any size, shape, design, construction, and material to be adapted for assembly. In its presently preferred form, an elongated dovetail tongue comprising a pair of upwardly divergent flanges is attached to the top surface of the blade. The tongue slips endwise into a closely conforming groove defined by the downwardly convergent walls of an inverted channel conveniently formed in the underside of the base of the handle.

In other embodiments of the invention, alternative structures are employed in place of the tongue and groove. For purposes of this disclosure, the tongue and its equivalent structures on the blade will be referred to generically from time to time as "mounts." Likewise, for convenience the groove and its functional equivalents associated with the handle sometimes will be referred to as "fittings."

The tongue ("mount") is longer than the groove ("fitting"), and one of the tongue's ends abuts a shoulder formed in one end of the groove. A keeper is adapted to slip onto the exposed end of the tongue protruding from the groove. A resilient detent arrangement secures the keeper to the base of the handle (and thus, to the groove), and retains a shoulder formed in the keeper in abutment with the adjacent end of the tongue.

A number of alternative embodiments fall within the scope of the invention. Variations in the construction of the interlocking sliding members will come to mind, for example, as will equivalent substitutes for the keeper and detent shown and described. More will be said of these later.

For a fuller understanding of the invention and its various modifications and applications, reference is made to the following detailed description of the preferred embodiment illustrated in the accompanying drawings, in which:

BRIEF DESCRIPTION OF THE DRAWINGS

FIG. 4 is an enlarged top frontal perspective view of the keeper shown in FIG. 1;

FIG. 5 is an enlarged fragmentary sectional view through the base of the handle seen in FIG. 4, taken in the direction 5—5, showing the slidingly interlocking tongue and groove structure and a portion of the detent mechanism;

FIG. 6 is a fragmentary side sectional view of the rear end of the base of the handle and the keeper seen in FIGS. 1, 4, and 5, taken in the direction 6—6 of FIG. 5, showing the keeper as it is being mounted to the tongue, with portions cut away to expose the underlying structure, and in particular the detent mechanism;

FIG. 7 is a sequential fragmentary side sectional view of the portion of the base and keeper seen in FIG. 6, with the detent mechanism fully engaged and with portions cut away to expose the underlying structure;

FIG. 8 is a reduced side elevational view of the trowel seen in FIG. 1, illustrating two successive steps in its assembly;

FIG. 9 is a fragmentary sectional view similar to FIG. 5, showing an alternative embodiment of the subject invention;

FIG. 10 is a fragmentary sectional detail view showing another alternative embodiment of the slidingly interlocking fittings of the invention; and FIG. 11 is a fragmentary sectional detail view similar to FIG. 10, showing still another alternative embodiment of the slidingly interlocking fittings.

Wherever practicable, the same numeral is used to identify identical or substantially similar features appearing in the several figures.

DETAILED DESCRIPTION OF THE PREFERRED EMBODIMENT

Figure 1:
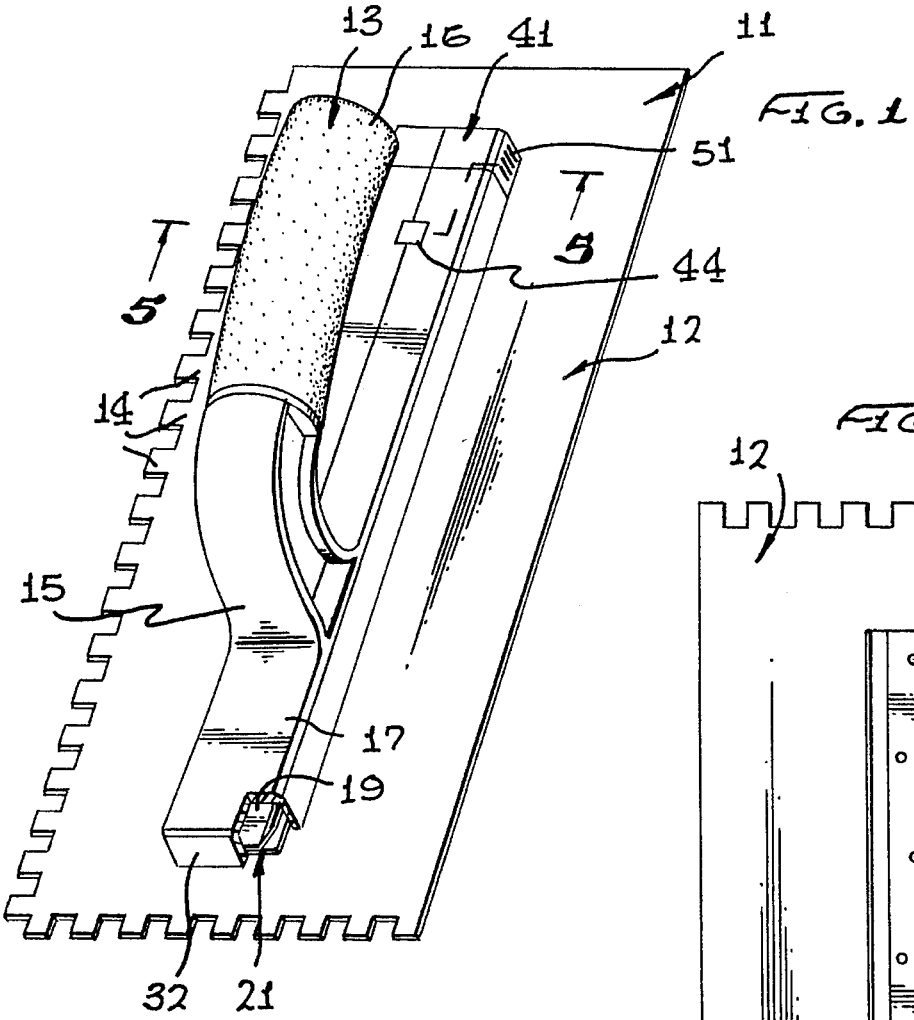
FIG. 1 is a top frontal perspective view of a hand trowel assembly in accordance with the subject invention, with portions of the handle base cut away to expose the underlying structure.

Referring to FIG. 1, the hand trowel 11 is made up of a blade 12 and a handle 13. The blade 12 need not be limited to any particular size, shape, design, or material. To the contrary, the invention lends itself to providing the worker a variety of readily replaceable blades from which he can choose the one best suited to each task. By way of example, although the blade 12 shown here is rectangular and has serations 14 in two of its edges for spreading certain types of mortar, it could be triangular and smooth-edged.

Handle 13 includes a supporting arm 15 having a grip 16 formed on it, and a base 17 adapted for mounting the handle 13 to the top surface of the blade 12. As with the blade, the size, shape, design, and material of handle 13 are to a great extent matters of choice. In the embodiment shown, the arm 15, grip 16, base 17 are formed as a unitary structure. However, if desired they could have been made and assembled as individual, separable components.

Handle 13 is attached to blade 12 by means of a fitting in handle 13 adapted for sliding, interlocking engagement with a mount on blade 12. In this instance, the fitting comprises an inverted dovetail groove 19 formed in base 17 and the mount takes the form of a tongue 21 attached to the top surface of blade 12. If desired, this arrangement can be reversed (not shown), the fitting in handle 13 being defined by an inverted tongue formed in its base, and the mount being an elongated, tongue-engaging groove formed on the upper surface of the blade.

In the embodiment shown in FIG. 1, the arm 15 and base 17 of handle 13 are formed of a suitable thermoplastic material, such as glass-filled Nylon, by conventional methods, such as injection molding. Employing common molding practices, as seen in FIG. 5, the walls of groove 19 are defined by a pair of inwardly directed flanges 22. To insure the rigidity of flanges 22, gussets 23 extending between flanges 22 and the wall 24 of base 17 are provided at intervals along base 17. Alternatively, base 17 could be molded with solid, downwardly thickened walls (not shown), rather than flanges 22, defining a longitudinal groove similar in section to groove 19.

Figure 2:
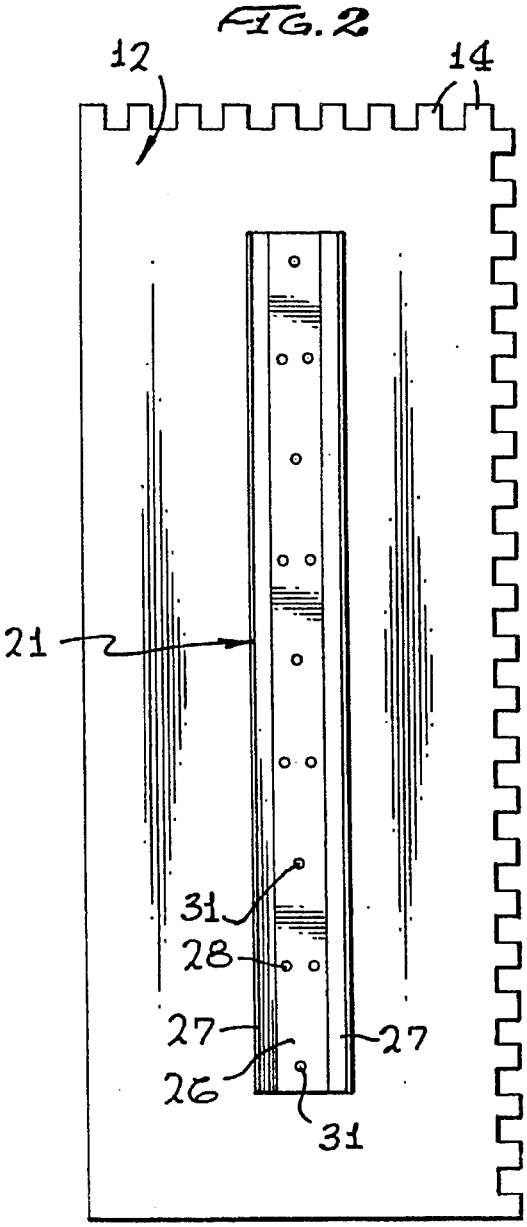
FIG. 2 is a top plan view of a trowel blade, such as that seen in FIG. 1 with the handle removed to show the mount structure.
Figure 3:
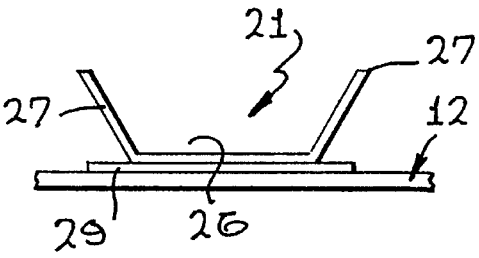
FIG. 3 is a fragmentary front elevational view of the blade seen in FIG. 2, showing the mounting flanges on its top surface.

As best seen in FIGS. 2 and 3, the mount defined by tongue 21 is formed of suitable material, such as stainless steel. For ease in fabrication, an elongated channel 26 having upstanding, outwardly inclined flanges 27 for walls is secured by spot welds 28 to a backing plate 29. Backing plate 29, in turn, is firmly attached to blade 12 by spot welds 31.

Flanges 27 are adapted for interlocking longitudinal sliding engagement with the flanges 22 forming the walls of groove 19 in base 17. When thus engaged, tongue 21 defined by channel 26 and flanges 27, and groove 19 cooperate to mount handle 13 rigidly to blade 12.

The front end of handle 13 is enclosed by an end wall 32. End wall 32, or some other suitable stop, such as a shoulder or constriction (neither one shown) formed in the wall of groove 19, serves to limit the forward travel of handle 13 on blade 12. To prevent handle 13 from slipping rearwardly under the forces exerted when the trowel is in use, the invention incorporates a novel retaining arrangement.

In fabricating the trowel, tongue 21 is made longer than groove 19. When handle 13 is mounted to blade 12 and slipped as far forwardly as the end wall 32 or other stop means will allow, a portion of tongue 21 extends, exposed, rearwardly of the rear end of groove 19. As illustrated in FIG. 4, a keeper 41 comprising an end cap 42 preferably similar, if not identical, to base 17 in section is adapted to slip over the exposed end of tongue 21. A detent, such as opening 43 in the top of base 17, and latching means, such as boss 44 at the end of resilient arm 45 formed on end cap 42, cooperate to secure end cap 42 to the rear end of tongue 21.

End cap 42 is designed so that when it is mounted to tongue 21 and secured to base 17 (and thus to tongue 21), its rear wall 43, or, as previously mentioned in connection with the forward end of base 17, other suitable stop means (not shown), prevents handle 13 from moving rearwardly on tongue 21. Resilient arm 45 urging boss 44 into opening 43, serves as a latching mechanism releasably securing handle 13 to blade 12.

FIGS. 6–8 illustrate the detailed construction of the detent and latching mechanism and their operation in the assembly of the trowel. As shown in FIGS. 6 and 7, end cap 42 is provided with ridges 51 or similar gripping means to facilitate its mounting and removal. With tongue 21 fully inserted in groove 19, cap 42 is mounted to the exposed rear end of tongue 21 by manually depressing arm 45 to allow boss 44 to slip under the top of base 17 and into groove 19. A taper 52 provided in the roof at the rear end of base 17 further facilitates the mounting procedure. As an alternative to first mounting handle 13 to blade 12 and then mounting and securing keeper 41 to tongue 21, keeper 41 can be mounted to tongue 21 first and handle 13 then mounted to tongue 21 and secured to keeper 41.

For purposes of this disclosure, it will be appreciated that the positioning of the detent and latching mechanism are not intended to be limited to the arrangement shown. If desired, for example, the resiliently biased boss can be mounted to the handle base, and the boss-receiving opening moved to the end cap (not shown). Likewise, other well known forms of detent and latching means (not shown) for securing the slidingly interlocking fitting and monut can be substituted for the mechanism shown here without departing from the spirit of the invention.

As mentioned earlier, the mount and fitting represented by tongue 21 and groove 19, respectively, may take a variety of other forms within the purview of the subject invention. FIG. 9 shows one such alternative construction. Here, the base 57 is solid throughout and the mount, tongue 58 and fitting, groove 59 are generally circular in section. A channel 61 extending forwardly from the rear end of base 57 and terminating in an opening 62 through the top of base 57 affords access to the opening 62 for boss 63. FIGS. 10 and 11 illustrate two further alternative embodiments of the slidingly interlocking mount and fitting of the invention. In FIG. 10, the mount takes the form of rigid, inverted "L"-shaped flanges 68 on blade 12 and the fitting is in the form of mating grooves 69 in base 67. In FIG. 11 the mount and fitting are two pairs of interlocking metal or plastic "J"-shaped flanges: flange 78 on blade 12, and flange 79 extending lengthwise in base 77. In each instance, the end cap (not shown) is configured with a fitting (groove 59, 69, 79) adapted to receive lengthwise whatever mount (tongue 58, 68, 78) is on the blade 12. In all other respects, such embodiments are intended to be functionally equivalent to, and operate in the same fashion as, the previously illustrated versions.

From the foregoing description, the advantages afforded by the novel features of the subject invention will be readily apparent. It should be understood, however, that while the invention has been described in terms of the constructions shown in the drawings and certain exemplary modifications thereof, it is not to be construed as limited to those embodiments. They are to be regarded as illustrative rather than restrictive. The invention encompasses any and all variations of the examples chosen for purposes of the disclosure, which do not depart from the spirit and scope of the following claims.

What is claimed is:

1. A hand trowel assembly, comprising:

a blade, said blade having a mount longitudinally disposed thereon;

a handle, said handle having a fitting in sliding, interlocking engagement with the mount and a first stop limiting the travel of the fitting in one direction with respect to the mount, the mount being longer than the fitting;

a keeper, said keeper being in sliding, interlocking engagement with the mount and including a second stop limiting the travel of the keeper with respect to the mount in the opposite direction and a latch releasably engaging said handle and thereby immovably securing the handle to said blade.

2. A hand trowel assembly in accordance with claim 1 wherein the mount is a tongue formed on said blade, and the fitting is a groove formed in said handle.

3. A hand trowel assembly in accordance with claim 2 wherein the first stop is a shoulder formed in the groove for abutment with the tongue, and the second stop is a shoulder formed on the keeper for abutment with the tongue.

4. A hand trowel assembly, comprising:

a blade having a tongue longitudinally disposed on its upper surface;

a handle having a base, the base including a groove in sliding, interlocking engagement with the tongue and a first shoulder abutting the tongue in one direction, the tongue being longer than the groove;

a keeper in sliding, interlocking engagement with the tongue, said keeper including a second shoulder abutting the tongue in the opposite direction and a latch releasably engaging the handle, whereby the tongue is immovably captured between the first and second shoulders.

5. A hand trowel assembly in accordance with claim 4 wherein the tongue comprises a pair of outwardly inclined flanges formed on said blade and the groove comprises a pair of corresponding inwardly inclined walls formed in the base.

6. A hand trowel assembly, comprising:

a blade, said blade having a mount longitudinally disposed on its upper surface;

a handle, said handle having a base including a fitting in sliding, interlocking engagement with the mount, a first stop limiting the travel of the fitting with respect to the mount in one direction, and a detent, the mount being longer than the fitting;

a keeper in sliding, interlocking engagement with the mount, said keeper including a second stop limiting the travel of the keeper with respect to the mount in the opposite direction and a latch releasably engaging the detent whereby the fitting is immovably secured to the mount.

7. A hand trowel assembly in accordance with claim 6 wherein the mount is a tongue formed on said blade, the fitting is a groove formed in said handle, and said keeper includes a groove slidingly receiving the tongue.

8. A hand trowel assembly in accordance with claim 7 wherein the first stop is a shoulder formed in the groove for abutment with the tongue, and the second stop is a shoulder formed in the keeper for abutment with the tongue.

9. A hand trowel assembly in accordance with claim 8 wherein:

the tongue comprises a pair of outwardly inclined flanges formed on said blade and the groove comprises a pair of corresponding inwardly inclined walls formed in the base;

the detent is a recess formed at one end of the base; and the latch comprises a resilient arm on said keeper urging a boss formed at its end into the recess.

10. A hand trowel assembly, comprising:

a blade, said blade having an elongated tongue longitudinally disposed on its upper surface;

a handle, said handle having a base containing an elongated groove in sliding, interlocking engagement with the tongue, one end of the groove containing a first shoulder abutting one end of the tongue and the other having a detent formed thereat, the tongue being longer than the groove;

a keeper, said keeper having a groove therein in sliding, interlocking engagement with the tongue, a second shoulder abutting the opposite end of the tongue, and a resilient latch releasably engaging the detent whereby the tongue is immovably captured between the first and second shoulders.

* * * * *